US012509811B2

(12) United States Patent
Banta et al.

(10) Patent No.: US 12,509,811 B2
(45) Date of Patent: Dec. 30, 2025

(54) DETECTING A PRESENCE OF OXYGEN BLEACH DURING A WASH CYCLE OF A WASHING MACHINE APPLIANCE

(71) Applicant: Haier US Appliance Solutions, Inc., Wilmington, DE (US)

(72) Inventors: Mark Banta, Pewee Valley, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 89 days.

(21) Appl. No.: 18/480,990

(22) Filed: Oct. 4, 2023

(65) Prior Publication Data

US 2025/0116049 A1 Apr. 10, 2025

(51) Int. Cl.

| | |
|---|---|
| ***D06F 34/22*** | (2020.01) |
| ***D06F 23/04*** | (2006.01) |
| ***D06F 33/34*** | (2020.01) |
| ***D06F 33/38*** | (2020.01) |
| ***D06F 33/44*** | (2020.01) |
| *D06F 103/22* | (2020.01) |
| *D06F 105/02* | (2020.01) |
| *D06F 105/52* | (2020.01) |
| *D06F 105/56* | (2020.01) |
| *D06F 105/58* | (2020.01) |

(52) U.S. Cl.

CPC ..... *D06F 34/22* (2020.02); *D06F 23/04* (2013.01); *D06F 33/34* (2020.02); *D06F 33/38* (2020.02); *D06F 33/44* (2020.02); *D06F 2103/22* (2020.02); *D06F 2105/02* (2020.02); *D06F 2105/52* (2020.02); *D06F 2105/56* (2020.02); *D06F 2105/58* (2020.02)

(58) Field of Classification Search

None

See application file for complete search history.

(56) References Cited

U.S. PATENT DOCUMENTS

| | | | | |
|---|---|---|---|---|
| 8,388,695 | B2 | 3/2013 | Hendrickson et al. | |
| 2009/0317311 | A1* | 12/2009 | Cocking | A47L 15/0055 422/261 |
| 2022/0162790 | A1 | 5/2022 | Zattin et al. | |

FOREIGN PATENT DOCUMENTS

| | | | | |
|---|---|---|---|---|
| CN | 109208258 | A | 1/2019 | |
| DE | 102007041069 | A1 | 3/2009 | |
| EP | 1978144 | A2 * | 10/2008 | A47L 15/0049 |
| WO | WO-2022146306 | A1 * | 7/2022 | D06F 33/37 |

* cited by examiner

*Primary Examiner* — Cristi J Tate-Sims

(74) *Attorney, Agent, or Firm* — Dority & Manning, P.A.

(57) ABSTRACT

A method for operating a washing machine appliance includes a step of initiating a wash cycle of a washing machine appliance. The method also includes a step of sensing, with a conductivity sensor, a conductivity measurement of a wash fluid within a tub of the washing machine appliance. The method further includes a step of determining, based on the sensed conductivity measurement and a baseline conductivity measurement, a change in conductivity value. The method also includes a step of detecting, based on the change in conductivity value, a presence of oxygen bleach within the wash fluid.

20 Claims, 5 Drawing Sheets

DETECTING A PRESENCE OF OXYGEN BLEACH DURING A WASH CYCLE OF A WASHING MACHINE APPLIANCE

FIELD

The present subject matter relates generally to washing machine appliances, and more particularly to systems and methods for detecting the presence of oxygen bleach during a wash cycle of a washing machine appliance.

BACKGROUND

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

Washing machine appliances can operate in numerous cycles. For example, the typical washing machine appliance may be operable in various wash cycles, rinse cycles, drain cycles, spin cycles, and self-clean cycles. The wash cycle may be the primary cycle in which articles within the washing machine appliance are washed and cleansed. Typically, washing machine appliances have defined wash cycles that may be selected by a user of the washing machine appliance, for instance, a normal wash cycle, a delicate wash cycle, a white wash cycle, etc. These wash cycles may also include additional user selected settings, for instance, soil level, water temperature, etc., that may further define the wash cycle. However, in some cases, it is advantageous to make real-time adjustments to the wash cycle based on wash additives that may be added by a user to the washing machine appliance. These real-time adjustments may improve the washing and/or rinsing capabilities and the overall performance of the washing machine appliance.

Accordingly, systems and methods that may be used to operate a washing machine appliance would be beneficial. Particularly, an algorithm that may be used to detect the presence of oxygen bleach in the tub of the washing machine appliance during a wash cycle would be useful.

BRIEF DESCRIPTION

Aspects and advantages of the invention will be set forth in part in the following description, or may be apparent from the description, or may be learned through practice of the invention.

In one exemplary embodiment, a method for operating a washing machine appliance is provided. The method may include a step of initiating a wash cycle of a washing machine appliance. The method may also include a step of sensing, with a conductivity sensor, a conductivity measurement of a wash fluid within a tub of the washing machine appliance. The method may further include a step of determining, based on the sensed conductivity measurement and a baseline conductivity measurement, a change in conductivity value. The method may also include a step of detecting, based on the change in conductivity value, a presence of oxygen bleach within the wash fluid.

In another exemplary embodiment, a washing machine appliance is provided. The washing machine appliance may include a tub. The washing machine appliance may also include a conductivity sensor disposed at the tub. The washing machine may further include a controller operable for: initiating a wash cycle of a washing machine appliance; sensing, with a conductivity sensor, a conductivity measurement of a wash fluid within a tub of the washing machine appliance; determining, based on the sensed conductivity measurement and a baseline conductivity measurement, a change in conductivity value; and detecting, based on the change in conductivity value, a presence of oxygen bleach within the wash fluid.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
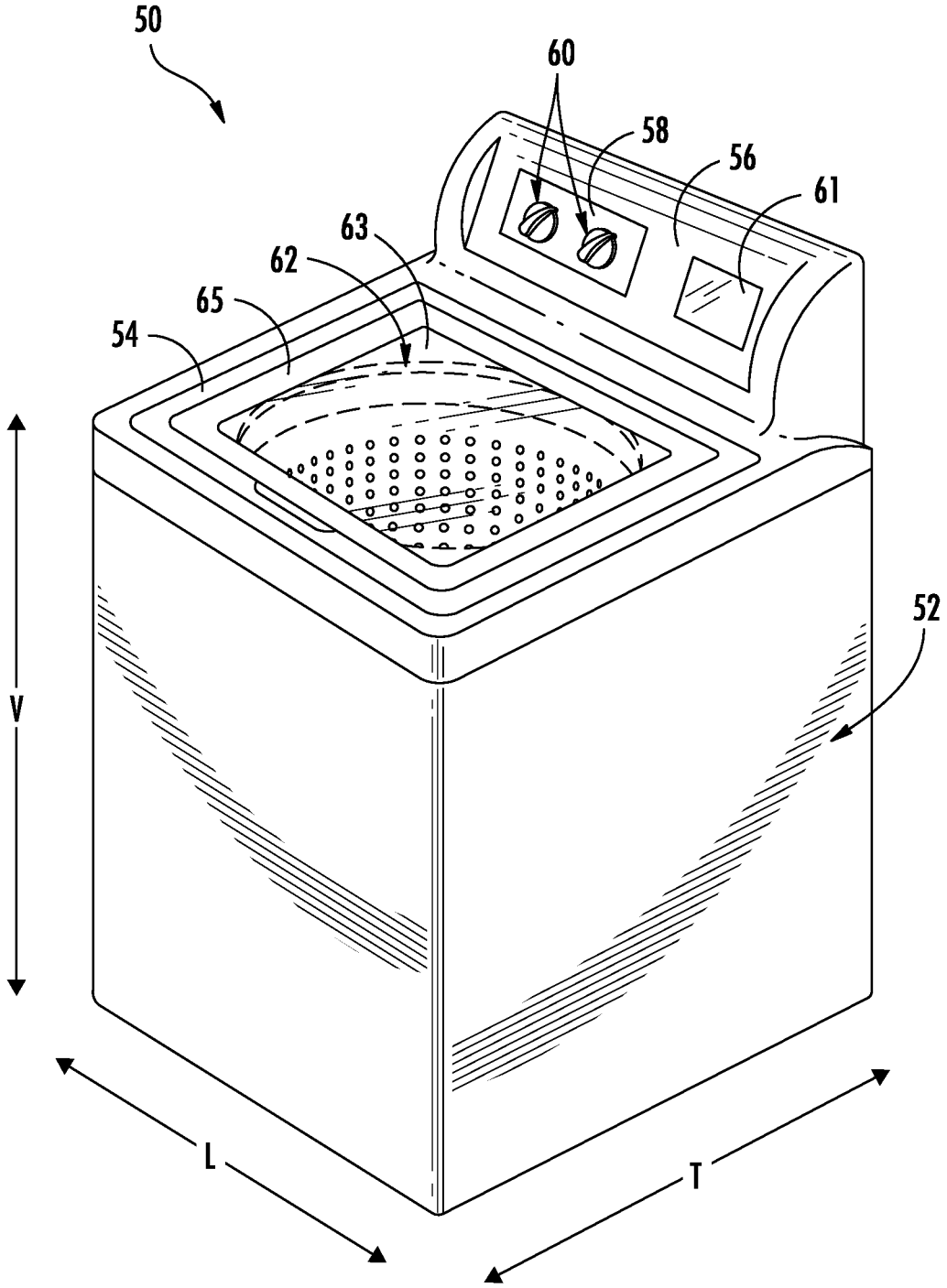
FIG. 1 provides a perspective view of a washing machine appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
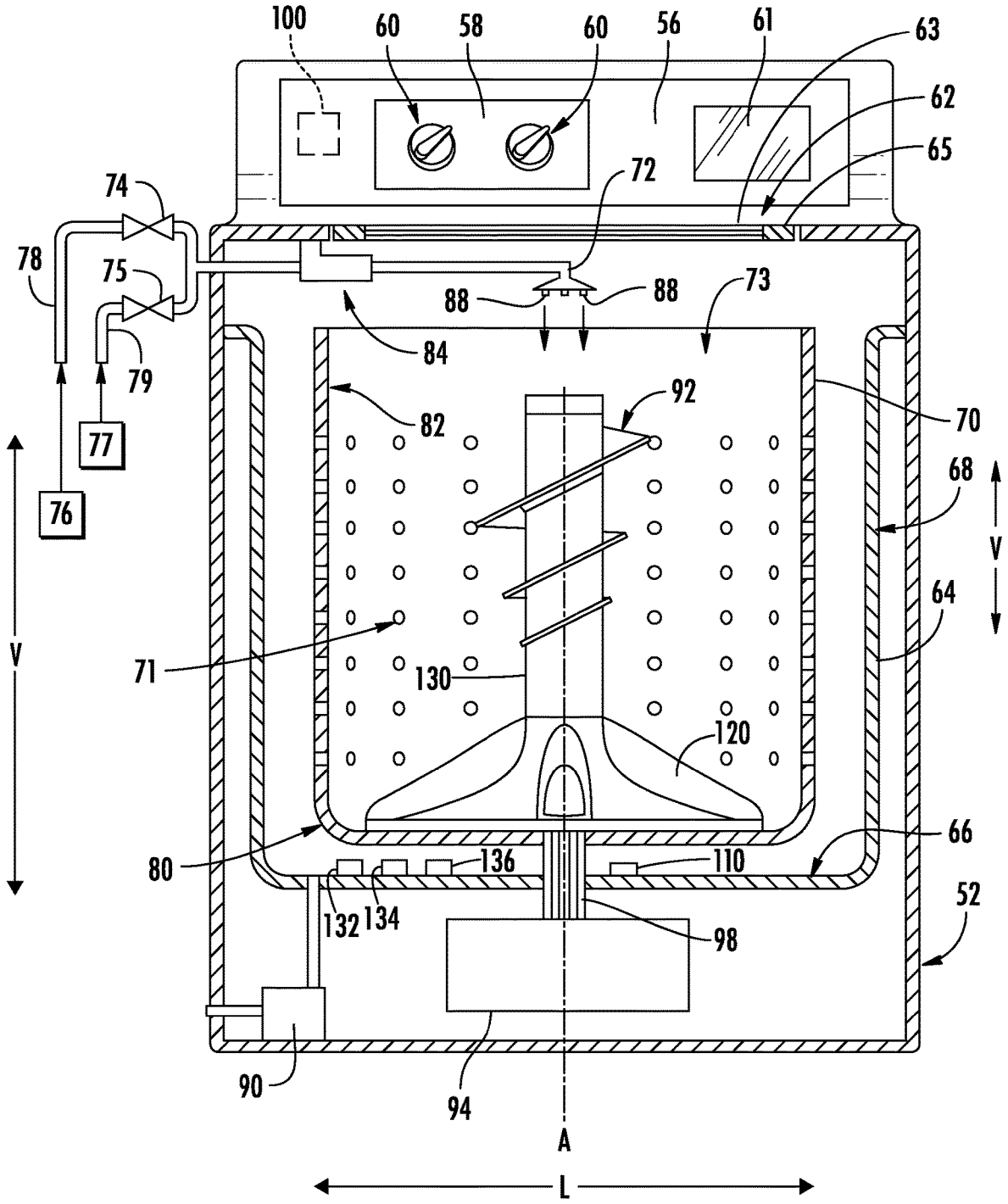
FIG. 2 provides a sectional elevation view of the exemplary washing machine appliance of FIG. 1.

Turning now to the figures, FIGS. 1 and 2 provide separate views of a washing machine appliance 50 according to example embodiments of the present disclosure. The washing machine appliance 50 may generally define a vertical direction V, a lateral direction L, and a transverse direction T. The vertical direction V, lateral direction L, and transverse direction T are each mutually perpendicular and form an orthogonal direction system.

One of ordinary skill in the art would understand that while described in the context of specific exemplary embodiment of the washing machine appliance 50, the present subject matter disclosed herein may be applicable to any suitable style, type, or configuration of washing machine appliance. For example, the present subject matter may also be applicable to front load washing machine appliances that may be commonly known in the art. Accordingly, the washing machine appliance 50 illustrated in FIGS. 1 and 2 may be provided by way of example only.

In some embodiments, the washing machine appliance 50 may include a cabinet 52 and a cover 54. In addition, a backsplash 56 may extend from cover 54, and a control panel 58, including a plurality of input selectors 60, may be coupled to the backsplash 56. In some embodiments, the control panel 58 and input selectors 60 may collectively form a user interface input for operator selection of machine cycles and features, and in one example embodiment, a display 61 may indicate selected features, a countdown timer, or other items of interest to machine users.

It should be appreciated, however, that in additional, or alternative, exemplary embodiments, the control panel 58, input selectors 60, and display 61, may have any other suitable configuration. For example, in other example embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub 64, which may also be referred to as a wash tub 64, located within cabinet 52 and a closed position (FIG. 1) forming an enclosure over tub 64. As illustrated in FIG. 1, the lid 62 may include a transparent panel 63. In some embodiments, the transparent panel 63 may be formed of, for example, glass, plastic, or any other suitable material. The transparency of the panel 63 allows users to see through the panel 63, and into the tub 64 when the lid 62 is in the closed position. In some exemplary embodiments, the panel 63 itself can generally form the lid 62. In other example embodiments, for instance, FIG. 1, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the example embodiment illustrated be a vertical axis. Thus, the exemplary washing machine appliance 50 may generally referred to as a vertical axis washing machine appliance or a top load washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g., water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or may be holes defined in the nozzles 72 or any other suitable openings through which water may be sprayed. Nozzle 72 may additionally include other openings, holes, etc. (not shown) through which water may be flowed (i.e., sprayed or poured) into the tub 64.

Various valves may regulate the flow of fluid through nozzle 72. For example, a flow regulator may be provided to control a flow of hot or cold water into the wash chamber of washing machine appliance 50. For the example embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

A dispenser 84 may additionally be provided for directing a wash additive, for example, liquid fabric softener, stain remover, whitening agents, scent boosters, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the example embodiment depicted, nozzle 72 is a separate downstream component from dispenser 84. In other example embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other example embodiments, the washing machine appliance 50 may not include a dispenser, in which case a user may add one or more wash additives directly to wash chamber 73. A pump assembly 90 (shown schematically in FIG. 2) may be located beneath tub 64 and basket 70 for gravity assisted flow to drain tub 64.

An agitation element 92 may be oriented to rotate about the rotation axis A (e.g., parallel to the vertical direction V). Generally, agitation element 92 includes an impeller base 120 and/or an extended post 130. The agitation element 92 depicted may be positioned within the basket 70 to impart motion to the articles and liquid in the chamber 73 of the basket 70. More particularly, the agitation element 92 depicted may be provided to impart downward motion of the articles along the rotation axis A. For example, with such a configuration, during operation of the agitation element 92 the articles may be moved downwardly along the rotation axis A at a center of the basket 70, outwardly from the center of basket 70 at the bottom portion 80 of the basket 70, then upwardly along the rotation axis A towards the top portion 82 of the basket 70.

In optional example embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) that may be selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be used. The pressure sensor 110 may generally measure the pressure of water in the tub 64. This pressure can then be used to estimate the height or amount of water in the tub 64. Pump 90 may be configured to operate in response to pressure sensor 110 measuring a water level exceeding a limit value, e.g., a maximum fill value. In other words, controller 100 may be configured to operate pump 90 to remove fluid from tub 64. Additionally, a suitable speed sensor can be connected to the motor 94, such as to the output shaft 98 thereof, to measure speed and indicate operation of the motor 94. Other suitable sensors, such as temperature sensors, water sensors, moisture sensors, etc., may additionally be provided in the washing machine appliance 50.

In addition to pressure sensor 110, washing machine appliance 50 may include a turbidity sensor 132, a conductivity sensor 134, or a temperature sensor 136. Each of the turbidity sensor 132, conductivity sensor 134, and temperature sensor 136 may be configured for signal communication with controller 100 described in more detail below. For example, each of the turbidity sensor 132, conductivity sensor 134, and temperature sensor 136 may send measurement data or signals to controller 100. In some example embodiments, the turbidity sensor 132, the conductivity sensor 134, and the temperature sensor 136 may be combined in any combination to reduce the total number of sensors in washing machine appliance 50. For instance, the turbidity sensor 132, the conductivity sensor 134, and the temperature sensor 136, may be combined into a single component, wherein the combination of the sensors may be referred to as a sensor assembly. Further, turbidity sensor 132, conductivity sensor 134, or temperature sensor 136 may be positioned in tub 64, e.g., on a bottom wall 66 of tub 64.

The conductivity sensor 134 may generally be utilized to sense a conductivity measurement of a wash fluid within the tub 64 of the washing machine appliance 50. However, in some instances, the conductivity measurements sensed by the conductivity sensor 134 may be highly influenced by the temperature of the wash fluid. For example, it may be known that the higher the temperature of a wash fluid, the higher a conductivity measurement it may have. Thus, embodiments of the present subject matter may advantageously apply a temperature compensation factor to sensed conductivity measurements to compensate, e.g., offset, for any impact that the temperature of the wash fluid may have on the conductivity measurement. In this regard, a nominal conductivity measurement, e.g., a temperature compensated conductivity measurement, may be determined. As an example, a nominal conductivity measurement may be calculated with the following equation.

$$\sigma_{nom} = \frac{\sigma_{meas}}{1 + TK * (T_{meas} - T_{nom})}$$

where $\sigma_{nom}$ is an expected conductivity measurement at a nominal temperature (e.g., $T_{nom}$) of the wash fluid.

$\sigma_{meas}$ is a sensed conductivity measurement of the wash fluid. The conductivity measurement may be sensed by the conductivity sensor 134.

TK is a temperature coefficient of the wash fluid.

$T_{meas}$ is a sensed temperature measurement of the wash fluid. The temperature measurement may be sensed by the temperature sensor 136.

$T_{nom}$ is a nominal temperature of the wash fluid (e.g., 25° C.).

Thus, the nominal conductivity measurement may be determined based on a sensed conductivity measurement and a sensed temperature measurement. Additionally, as should be appreciated, the exemplary equation described above may be dependent on the one or more sensors (e.g., the conductivity sensor 134, the temperature sensor 136, etc.) that may be present within the washing machine appliance 50.

Referring again to FIG. 2, the control panel 58 of the washing machine appliance 50 may represent a general-purpose Input/Output ("GPIO") device or functional block for the washing machine appliance 50. In some embodiments, the control panel 58 may include or be in operative communication with one or more user input devices 60, such as one or more of a variety of digital, analog, electrical, mechanical, or electro-mechanical input devices including rotary dials, control knobs, push buttons, toggle switches, selector switches, and touch pads. Additionally, as described above, the washing machine appliance 50 may include the display 61. In some embodiments, the display 61 may be a digital or analog display device generally configured to provide visual feedback regarding the operation of the washing machine appliance 50. For example, display 61 may be provided on control panel 58 and may include one or more status lights, screens, or visible indicators. According to exemplary embodiments, the user input devices 60 and display 61 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

The washing machine appliance 50 may further include or be in operative communication with a processing device or a controller 100 that may be generally configured to facilitate operation of the washing machine appliance 50. In this regard, control panel 58, user input devices 60, and display 61 may be in communication with controller 100 such that controller 100 may receive control inputs from user input devices 60, may display information using display 61, and may otherwise regulate operation of the washing machine appliance 50. For example, signals generated by controller 100 may operate the washing machine appliance 50, including any or all system components, subsystems, or interconnected devices, in response to the position of user input devices 60 and other control commands. Control panel 58 and other components of the washing machine appliance 50, such as the flow regulator (including valves 74, 75), the motor 94, the pressure sensor 110, turbidity sensor 132, the conductivity sensor 134, the temperature sensor 136, etc., may be in communication with controller 100 via, for example, one or more signal lines or shared communication busses. In this manner, Input/Output ("I/O") signals may be routed between controller 100 and various operational components of the washing machine appliance 50.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 100 may be constructed without using a microprocessor, e.g., using a combination of discrete analog or digital logic circuitry (such as switches, amplifiers, integrators, comparators, flip-flops, AND/OR gates, and the like) to perform control functionality instead of relying upon software.

Controller 100 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information or data accessible by the one or more processors, including instructions that can be executed by the one or more processors. It should be appreciated that the instructions can be software written in any suitable programming language or can be implemented in hardware. Additionally, or alternatively, the instructions can be executed logically or virtually using separate threads on one or more processors.

For example, controller 100 may be operable to execute programming instructions or micro-control code associated with an operating cycle, for instance, a wash cycle, of the washing machine appliance 50. In this regard, the instructions may be software or any set of instructions that when executed by the processing device, cause the processing device to perform operations, such as running one or more software applications, displaying a user interface, receiving user input, processing user input, etc. Moreover, it should be noted that controller 100 as disclosed herein is capable of and may be operable to perform any methods, method steps, or portions of methods as disclosed herein. For example, in some embodiments, methods disclosed herein may be embodied in programming instructions stored in the memory and executed by controller 100.

The memory devices may also store data that can be retrieved, manipulated, created, or stored by the one or more processors or portions of controller 100. The data can include, for instance, data to facilitate performance of methods described herein. The data can be stored locally (e.g., on controller 100) in one or more databases or may be split up so that the data is stored in multiple locations. In addition, or alternatively, the one or more database(s) can be connected to controller 100 through any suitable network(s), such as through a high bandwidth local area network (LAN) or wide area network (WAN). In this regard, for example, controller 100 may further include a communication module or interface that may be used to communicate with one or more other component(s) of the washing machine appliance 50, controller 100, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Figure 3:
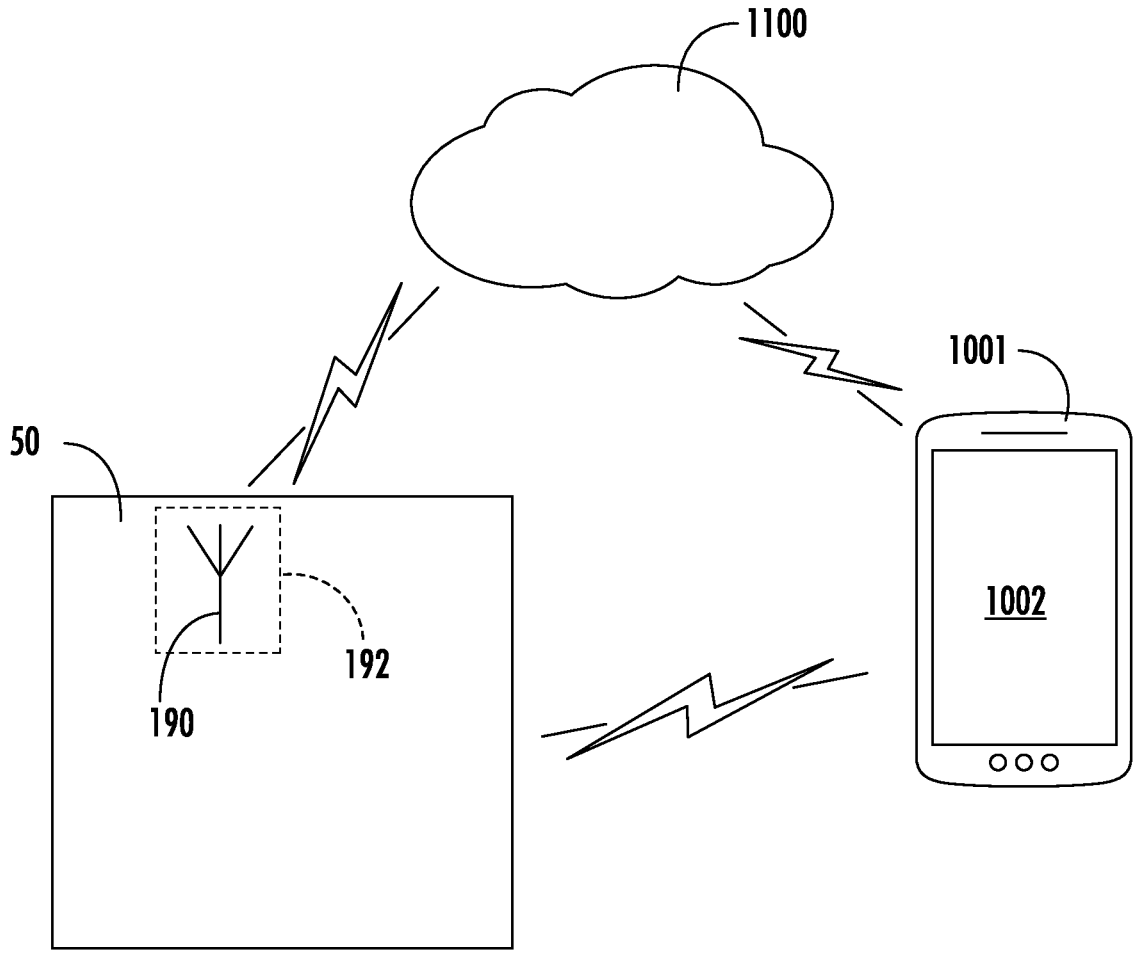
FIG. 3 provides a diagrammatic illustration of a washing machine appliance in communication with a remote computing device and with a remote user interface device according to one or more exemplary embodiments of the present subject matter.

A general schematic of a washing machine appliance, such as but not limited to washing machine appliance 50 described above, which communicates wirelessly with a remote user interface device 1001 and a network 1100 is provided in FIG. 3. For example, as illustrated in FIG. 3, the washing machine appliance 50 may include an antenna 190 by which the washing machine appliance 50 communicates with, e.g., sends and receives signals to and from, the remote user interface device 1001 or network 1100. The antenna 190 may be part of, e.g., onboard, a communications module 192. The communications module 192 may be a wireless communications module operable to connect wirelessly, e.g., over the air, to one or more other devices via any suitable wireless communication protocol. For example, the communications module 192 may be a WI-FI® module, a BLUETOOTH® module, or a combination module providing both WI-FI® and BLUETOOTH® connectivity. The remote user interface device 1001 may be a laptop computer, smartphone, tablet, personal computer, wearable device, smart speaker, smart home system, or various other suitable devices. The communications module 192 may be onboard the controller 100 or may be a separate module.

The washing machine appliance 50 may be in communication with the remote user interface device 1001 device through various possible communication connections and interfaces. The washing machine appliance 50 and the remote user interface device 1001 may be matched in wireless communication, e.g., connected to the same wireless network. The washing machine appliance 50 may communicate with the remote user interface device 1001 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the washing machine appliance 50 and the remote user interface device 1001. For example, BLUETOOTH® Low Energy may advantageously minimize the power consumed by the exemplary methods and devices described herein due to the low power networking protocol of BLUETOOTH® Low Energy.

The remote user interface device 1001 is "remote" at least in that it is spaced apart from and not structurally connected to the washing machine appliance 50, e.g., the remote user interface device 1001 is a separate, stand-alone device from the washing machine appliance 50 which communicates with the washing machine appliance 50 wirelessly. Any suitable device separate from the washing machine appliance 50 that is configured to provide or receive communications, information, data, or commands from a user may serve as the remote user interface device 1001, such as a smartphone (e.g., as illustrated in FIG. 3), smart watch, personal computer, smart home system, or other similar device. For example, the remote user interface device 1001 may be a smartphone operable to store and run applications, also known as "apps," and some or all of the method steps disclosed herein may be performed by a smartphone app.

The remote user interface device 1001 may include a memory for storing and retrieving programming instructions. Thus, the remote user interface device 1001 may provide a remote user interface which may be an additional user interface. For example, the remote user interface device 1001 may be a smartphone operable to store and run applications, also known as "apps," and the additional user interface may be provided as a smartphone app.

As mentioned above, the washing machine appliance 50 may also be configured to communicate wirelessly with a network 1100. The network 1100 may be, e.g., a cloud-based data storage system including one or more remote computing devices such as remote databases or remote servers, which may be collectively referred to as "the cloud." The network 1100 may include, e.g., one or more remote computing devices, such as a remote database, remote server, etc., in a distributed computing environment. Such distributed computing environments may include, for example, cloud computing, fog computing, or edge computing. For example, the washing machine appliance 50 may communicate with the network 1100 over the Internet, which the washing machine appliance 50 may access via WI-FI®, such as from a WI-FI® access point in a user's home, or in a laundromat or dormitory, etc.

The remote user interface device 1001 may be configured to capture and/lor display images. For example, the remote user interface device 1001 may be a smartphone, e.g., as illustrated in FIG. 3, which includes both a camera (not shown) for capturing images and a display 1002, e.g., a touchscreen or other screen, for displaying images.

As noted above, controller 100 is capable of and may be operable to perform any methods, method steps, or portions of methods as disclosed herein. Additionally, such methods, methods steps or portions of methods may be performed locally (e.g., on controller 100) or remotely, e.g., by a remote computing device (e.g., in the "edge," the "fog," or in the "cloud," as those of ordinary skill in the art will recognize as referring to a remote computing device, such as a server, database, or the like, in a distributed computing environment including at least one remote computing device in communication with the local controller 100, such as the exemplary network 1100 illustrated in FIG. 3 and described above). Also, by way of example, such performance may be mixed, such as partially local and partially remote.

The exemplary washing machine appliance 50 may be capable of operating in numerous cycles, for instance, to wash articles such as clothing that may be held within the basket 70 of the washing machine appliance 50. In some embodiments, the washing machine appliance 50 may include a wash cycle and a rinse cycle, among other cycles. The wash cycle may be the primary cycle of the washing machine appliance 50 wherein articles held within the basket 70 are washed and cleaned. The rinse cycle may be a separate cycle wherein fresh water is added to the tub 64 of the washing machine appliance 50 to ensure that any remaining wash additives, for example, detergent, fabric softener, bleach, etc., have been removed from the articles.

Typically, the wash cycle may be initiated by the washing machine appliance 50 receiving an input indicative of a selection of the wash cycle. For example, a user of the washing machine appliance 50 may manipulate the input selectors 60 to select a desired wash cycle of the washing machine appliance 50. In some embodiments, prior to the initiation of the wash cycle, wash additives may be added to the tub 64 of the washing machine appliance 50. For instance, wash additives, for example, detergent, oxygen bleach, etc., may be added directly to the tub 64 of the washing machine appliance 50. Additionally, or alternatively, wash additives may be added to the tub 64 of the washing machine appliance 50 via the dispenser 84 wherein the wash additives may be selectively dispensed into the tub 64 at desired portions of the wash cycle.

After the wash cycle has been initiated, a fill of liquid water may be flowed into the tub 64 of the washing machine appliance 50. The fill of liquid water may be mixed with the wash additives that may be added to the tub 64, or the wash additives that may be dispensed into the tub 64, to form a wash fluid that may be used to clean articles within the tub 64. Once the tub 64 is filled with liquid water, the agitation element 92 may rotate or move back and forth to agitate the articles within the tub 64. This agitation may facilitate cleaning of the articles within the tub 64 by helping the wash fluid to penetrate the fabric of the articles within the tub, for instance, to remove dirt and stains from the articles. In addition, in some embodiments, an optional soaking phase of the wash cycle may be initiated. The soaking phase may be an additional phase of the wash cycle wherein the articles within the tub may sit within the wash fluid for a period of time to further clean the articles within the tub. After the soaking phase, the washing machine appliance 50 may drain the dirty wash fluid from the tub 64 in preparation for the rinse cycle.

The rinse cycle of the washing machine appliance 50 may be initiated after the completion of the wash cycle. Generally, the rinse cycle may rinse and remove any remaining wash fluid from the articles within the tub 64 of the washing machine appliance 50. The rinse cycle may include a filling phase wherein a flow of clean liquid water may be flowed into the tub 64. The rinse cycle may also include an additional agitation phase wherein the agitation element 92 may again move back and forth to agitate the articles within the tub 64 and help remove any remaining wash fluid from the articles. After the agitation phase, the water within the tub 64 may be drained from the tub 64. The washing machine appliance 50 may then initiate a spin cycle wherein the basket 70 may spin rapidly to remove any excess water from the articles.

Typically, the washing machine appliance 50 may have pre-defined wash cycles, for instance, a normal wash cycle, a white wash cycle, a delicate wash cycle, etc., and pre-defined rinse cycles, for instance, a water volume adjustment, sequential rinse cycles, etc., that may be based on a user's selection or preference. However, there are advantages to adjusting the wash cycle and rinse cycle in real time, for instance, based on the wash additive that may be added to the washing machine appliance 50 during the wash cycle. For instance, in some embodiments, chlorine-free oxygen bleach, or more simply oxygen bleach, may be added, for example, by a user of the washing machine appliance 50, to the tub 64 of the washing machine appliance 50 prior to, during, or after the fill of liquid water has been flowed into the tub 64.

One of ordinary skill in the art would understand that oxygen bleach may generally refer to sodium percarbonate ($Na_2H_3CO_6$), or commercially available products that may include a mixture of sodium percarbonate and additional compounds, for example, a combination of sodium percarbonate and sodium carbonate ($Na_2CO_3$). In some embodiments, oxygen bleach may be a powder based bleach that may be utilized to enhance the cleaning ability of a wash cycle. Particularly, oxygen bleach may be advantageous due to its ability to enhance the color and brightness of colored articles, for instance, as opposed to chlorine bleach that may only be suitable when used with light or white colored articles.

Figure 4:
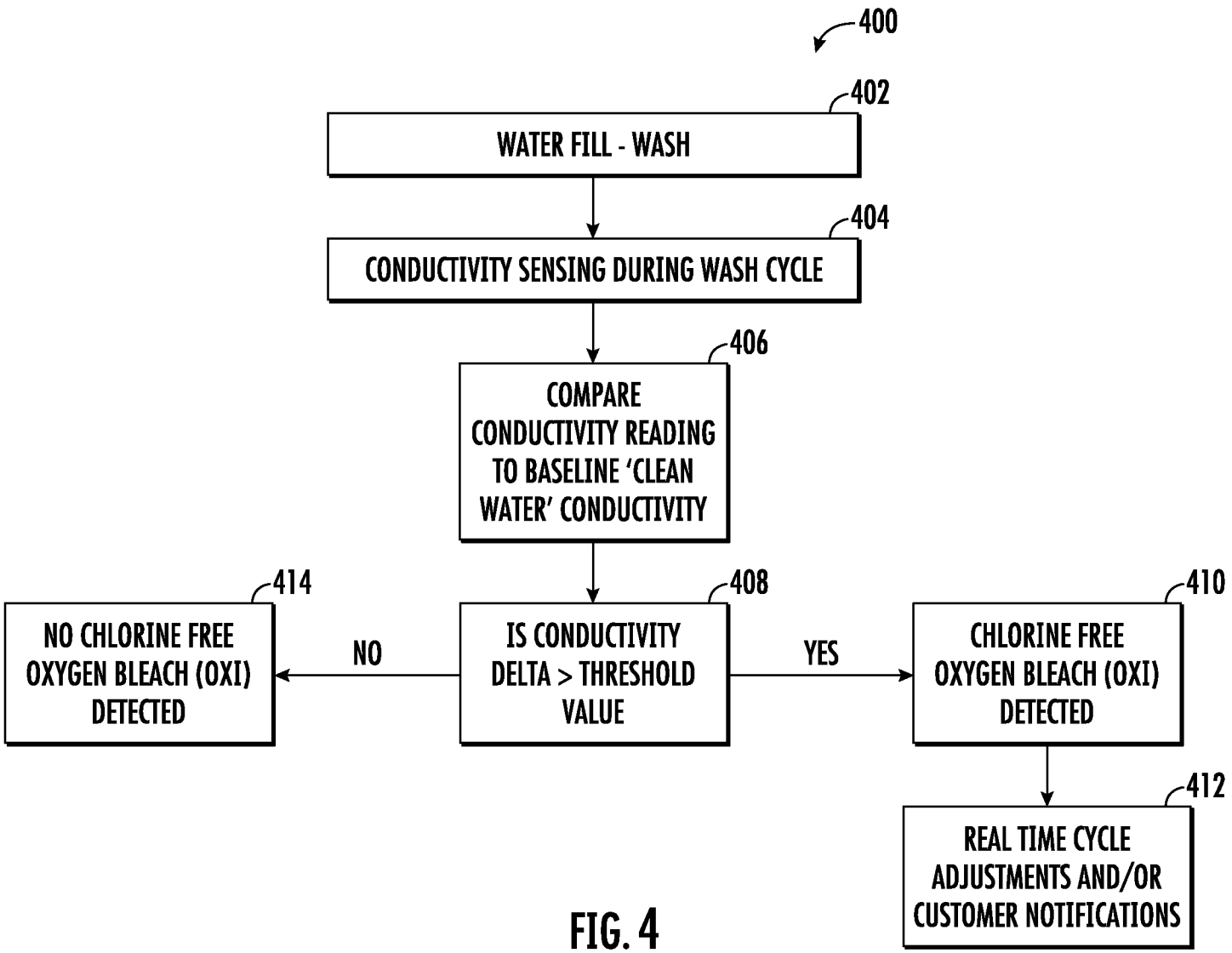
FIG. 4 provides a flow diagram of an algorithm that may be used to detect a presence of a oxygen bleach during a wash cycle of a washing machine appliance according to one or more exemplary embodiments of the present subject matter.

In such embodiments, it may be advantageous for the washing machine appliance 50 to automatically adjust the wash cycle or the rinse cycle when the presence of oxygen bleach may be detected within the wash fluid during the wash cycle. For instance, oxygen bleach may typically be added to the wash fluid to remove stains, brighten the color of articles, or whiten the color of articles, sanitize the articles, among other uses, during the wash cycle. In such instances, longer wash cycles and rinse cycles, multiple rinse cycles, or higher wash temperatures may improve the overall performance of the wash cycle. Thus, referring now to FIG. 4, a flow diagram of an algorithm 400 that may be used to operate a wash cycle of a washing machine appliance, such as the washing machine appliance 50, according to one or more exemplary embodiments of the present subject matter is provided. The algorithm 400 described herein, and illustrated in FIG. 4, may be implemented on any suitable washing machine appliance, for example, to operate the washing machine appliance. For instance, a controller of the washing machine appliance, such as the controller 100 of the washing machine appliance 50, may be operable for implementing the functions of the algorithm 400 such as to operate the washing machine appliance.

In some embodiments, the algorithm 400 may include a process function 402 of flowing a fill of liquid water to a tub of the washing machine appliance, for example, tub 64 of the washing machine appliance 50. As described above, the washing machine appliance may include a nozzle, for instance, nozzle 72, that may be configured for flowing the fill of liquid water into the tub. In some embodiments, the process function 402 may include regulating the flow of the fill of liquid water with various valves, for instance, hot water valve 74 and cold water valve 75, of the washing machine appliance.

The algorithm 400 may include a process function 404 of sensing, with a conductivity sensor, such as the conductivity sensor 134, a conductivity measurement of a wash fluid within the tub of the washing machine appliance during a wash cycle of the washing machine appliance. More particularly, the sensed conductivity measurement may be a sensed nominal conductivity measurement. For instance, as described above, conductivity of a wash fluid may be highly influenced by the temperature of the wash fluid. In this regard, the process function 404 may also include determining the nominal conductivity measurement of the wash fluid. For example, the nominal conductivity measurement of the wash fluid may be determined by utilizing the equation described above.

In some embodiments, the fill of liquid water that may flow into the tub of the washing machine appliance may mix with a wash additive, for instance, oxygen bleach, to form a wash fluid that may be used during the wash cycle of the washing machine appliance. For example, in some embodiments, the wash additive, for instance, oxygen bleach, may be added to the tub of the washing machine appliance prior to the fill of liquid water being flowed into the tub, for instance, prior to the execution of process function 402. As another example, in some embodiments, the wash additive, for instance, oxygen bleach, may be dispensed into the fill of liquid water via a dispenser, for example, dispenser 84, at desired times during the wash cycle.

In some embodiments, the process function 404 may be executed one or more times during the wash cycle of the washing machine appliance. For example, the process function 404 may be executed at the end of a wash cycle and the conductivity measurement may correspond to the conductivity of the wash fluid within the tub at the end of the wash cycle. As another example, the process function 404 may be executed a plurality of times during a wash cycle, for instance, during the beginning, middle, and end of the wash cycle, to obtain standalone and/or an average conductivity measurement of the wash fluid throughout the wash cycle.

As yet another example, in some embodiments, the washing machine appliance may include a valve in operative communication with a controller, e.g., the controller 100. The valve may be in fluid communication with a dispenser of the washing machine appliance and may selectively permit water to flush the dispenser of the washing machine appliance. In such embodiments, the process function 404 may be executed prior to before and after the actuation of the valve.

In some embodiments, the algorithm 400 may also include a process function 406 wherein the conductivity measurement is compared to the baseline conductivity measurement. In some embodiments, the baseline conductivity measurement may correspond to a clean water value, for instance, a conductivity value representative of the liquid water that may be flowed into the tub of the washing machine appliance. The baseline conductivity measurement may be determined in numerous ways. For instance, in some embodiments, the baseline conductivity measurement may be determined by performing a calibration cycle for the conductivity sensor. In addition, in some embodiments, the baseline conductivity value may be determined by sensing, with the conductivity sensor, the conductivity of the tub during a previous rinse cycle. Further, in some embodiments, the baseline conductivity value may be determined by sensing, with the conductivity sensor, the conductivity of the fill of liquid water, for instance, at process function 402, if it may be known that oxygen bleach has not previously been added to the tub.

In addition, in some embodiments, additional wash additives other than oxygen bleach, for example, detergent, fabric softener, etc., may be added to the wash fluid at various predetermined times in the wash cycle. In such embodiments, the baseline conductivity measurement may correspond to the conductivity value representative of the wash fluid that may not yet contain oxygen bleach. For instance, in some embodiments, wash additives, for example, detergent, fabric softener, oxygen bleach, etc., may be selectively dispensed into the tub to mix with the wash fluid. In such embodiments, the baseline conductivity measurement may correspond to the conductivity measurement of the wash fluid prior to the addition of oxygen bleach. For example, the baseline conductivity measurement may correspond to a conductivity measurement of a wash fluid that contains only liquid water and detergent.

In some embodiments the process function 406 may include determining a change in conductivity value, for instance, a conductivity delta, that may be based on the conductivity measurement, for instance, as sensed at process function 404, and the baseline conductivity measurement. The change in conductivity value may be the difference between the baseline conductivity measurement and the sensed conductivity measurement. In response to the process function 406 being executed, the algorithm 400 may include a decision function 408 wherein the determined change in conductivity value is compared to a threshold value. In some embodiments, the threshold value may be based on a minimum threshold value that may represent a minimum change in conductivity value between the sensed conductivity measurement and the baseline conductivity measurement. For example, in some embodiments, the minimum threshold value may be at least approximately seven hundred micro-Siemens per centimeter (700 μS/cm), such as a minimum threshold value of approximately one thousand micro-Siemens per centimeter (1000 μS/cm), such as a minimum threshold value of approximately one thousand five hundred micro-Siemens per centimeter (1500 μS/cm), such as a minimum threshold value of approximately one thousand seven hundred fifty micro-Siemens per centimeter (1750 μS/cm).

In some instances, at the decision function 408, based on the comparison of the change in conductivity value to the threshold value, it may be determined that the change in conductivity value is greater than the threshold value. In such instances, the algorithm 400 may execute a process function 410, wherein oxygen bleach may be detected within the wash fluid. In response to oxygen bleach being detected within the wash fluid, the algorithm 400 may execute a process function 412. Process function 412 may include adjusting, in real time, the wash cycle. In some embodiments, adjusting the wash cycle may include increasing the time of the wash cycle. In some cases, oxygen bleach may be added later in the wash cycle. For instance, a user may add the oxygen bleach to the tub during the agitation phase. In such instances, it may be advantageous to increase the time of the wash cycle to ensure that the washing machine appliance has adequately cleaned and sanitized the articles within the tub.

Additionally, or alternatively, the process function 412 may include adjusting the rinse cycle of the washing machine appliance when oxygen bleach may be detected within the wash fluid during the wash cycle. For instance, the adjustments may include providing a water volume adjustment, for example, an extended and thorough rinsing cycle that may be performed after the main portion of the wash cycle has been completed. In some embodiments, the water volume adjustment may be performed to ensure that all wash additives, and more particularly, oxygen bleach, has been rinsed and removed from the articles within the tub of the washing machine appliance. Additionally, or alternatively, the adjustments to the rinse cycle may include providing an extra rinse cycle that may be initiated prior to the typical rinse cycle.

Moreover, in some embodiments, the process function 412 may include providing a first notification, for instance, a first user notification to a user of the washing machine appliance. In some embodiments, the first notification may be provided via a remote user interface device, such as the remote user interface device 1001, or a user interface on the washing machine appliance, such as the display 61. In addition, in some embodiments, the first notification may include a prompt that may indicate that oxygen bleach was detected within the tub during the wash cycle of the washing machine appliance. Further the first prompt may indicate that adjustments to the wash cycle or the rinse cycle were made to improve the overall performance of the washing machine appliance.

Alternatively, in some instances, at the decision function 408, based on the comparison of the change in conductivity value to the threshold value, it may be determined that the change in conductivity value is less than or equal to the threshold value. In such instances, the algorithm 400 may execute a process function 414, wherein oxygen bleach may not be detected within the wash fluid in the tub.

In addition, the process function 414 may include providing a second notification, for instance, a second user notification to a user of the washing machine appliance. In some embodiments, the second notification may be provided via a remote user interface device, such as the remote user interface device 1001, or a user interface on the washing machine appliance, such as the display 61. In addition, in some embodiments, the second notification may include a prompt that may indicate that oxygen bleach was not detected within the tub during the wash cycle of the washing machine appliance.

Further, in some embodiments, the algorithm 400 may include a process function wherein the temperature of the wash fluid may be detected during the wash cycle, for instance, by a temperature sensor disposed at the tub, such as temperature sensor 136 described above. For oxygen bleach to fully dissolve within the wash fluid, the temperature of the wash fluid may be required to be greater than or equal to a predetermined temperature threshold. In some instances, the process function may determine that the temperature of the wash fluid may be too low, for instance, the sensed temperature may be less than the predetermined temperature threshold. In such instances, the process function may include providing a third notification, for instance, a third user notification to a user of the washing machine appliance. In some embodiments, the third notification may be provided via a remote user interface device, such as the remote user interface device 1001, or a user interface on the washing machine appliance, such as the display 61. In addition, in some embodiments, the third notification may include a prompt that may indicate that the water temperature is too low to ensure that the oxygen bleach has fully dissolved in the wash fluid during the wash cycle.

Figure 5:
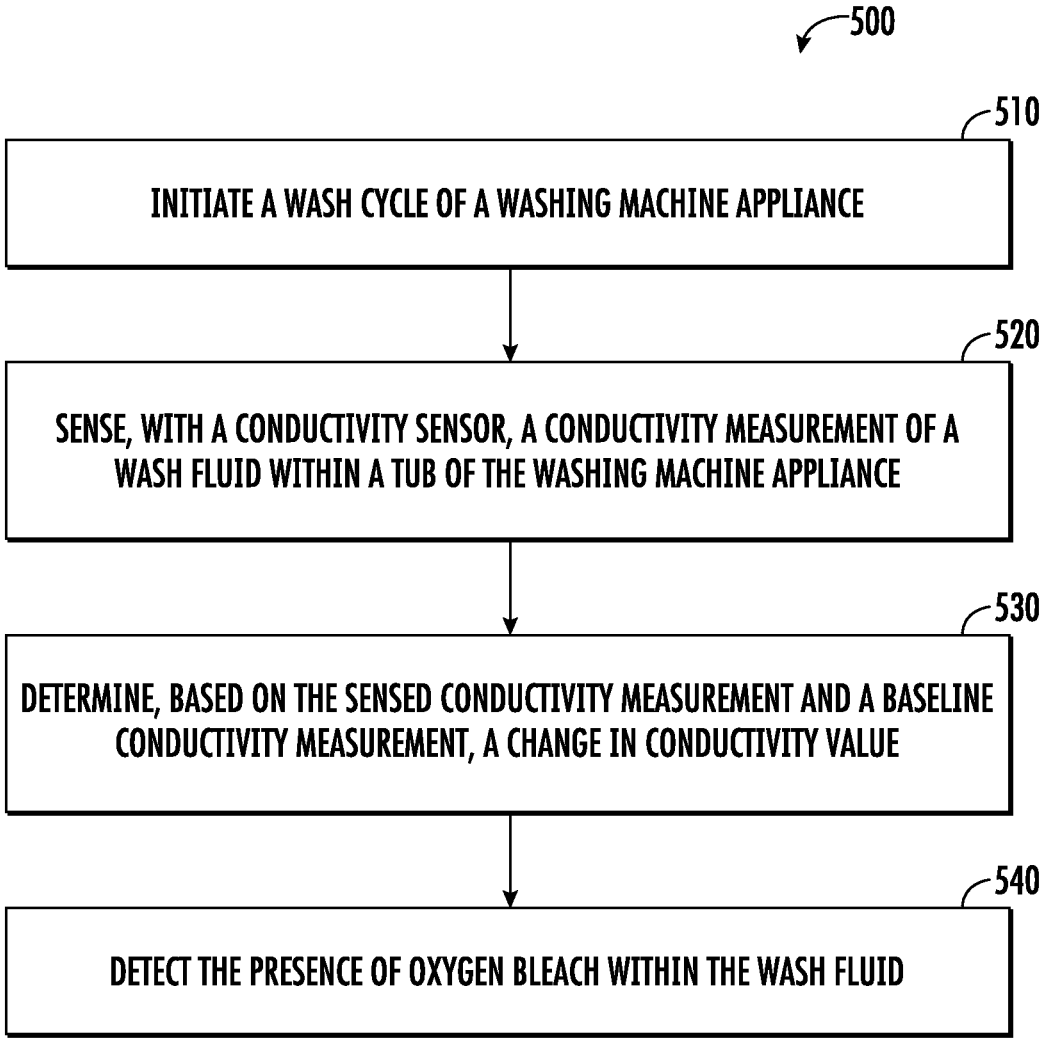
FIG. 5 provides a flow chart of an exemplary method of operating a washing machine appliance according to one or more exemplary embodiments of the present subject matter.

Referring now to FIG. 5, embodiments of the present subject matter may include one or more methods for operating a washing machine appliance, such as the exemplary washing machine appliance 50 described above, as well as other possible exemplary washing machine appliances. The exemplary methods according to the present subject matter may include a method 500, for example, as illustrated in FIG. 5. A controller of the washing machine appliance, such as the controller 100 of the exemplary washing machine 50, may be programmed to implement method 500, for example, the controller, such as controller 100, may be capable of and may be operable to perform any methods and associated method steps as disclosed herein.

In some embodiments, the method 500 may include a step 510 of initiating a wash cycle of a washing machine appliance. In some embodiments, the step 510 may include flowing a fill of liquid water into the tub, for instance, as described in more detail above with reference to washing machine appliance 50. Additionally, the step 510 may include recording, with a conductivity sensor such as the conductivity sensor 134, the baseline conductivity measurement, wherein the baseline conductivity measurement is a conductivity measurement of clean water, for example, the conductivity measurement of liquid water within the tub during a previous rinse cycle, the conductivity measurement of liquid water determined via calibration of the conductivity sensors, or the conductivity measurement of the fill of liquid water, for instance, as provided at step 510.

The method 500 may also include a step 520 of sensing, with the conductivity sensor, a conductivity measurement of a wash fluid within a tub of the washing machine appliance. In some embodiments, after the fill of liquid water has been flowed into the tub of the washing machine appliance, it may mix with a wash additive, for example, oxygen bleach, to form the wash fluid. Thus, at step 520, the conductivity measurement of the wash fluid may be the conductivity measurement of a wash fluid that may contain oxygen bleach. Further, the method 500 may include a step 530 of determining, based on the sensed conductivity measurement, for instance, as sensed at step 520, and a baseline conductivity measurement, for instance, the conductivity measurement of "clean water," a change in conductivity value.

The method 500 may also include a step 540 of detecting, based on the change in conductivity value, a presence of oxygen bleach within the wash fluid. More particularly, the step 540 may include detecting, based on the change in conductivity value and a threshold value, the presence of oxygen bleach within the wash fluid. In some embodiments, the threshold value may be based on a minimum threshold value that may represent a minimum change in conductivity measurements between the sensed conductivity measurement and the baseline conductivity measurement. For example, in some embodiments, the minimum threshold value may be approximately seven hundred micro-Siemens per centimeter (700 μS/cm).

In some embodiments at step 540 the presence of oxygen bleach is detected within the wash fluid in response to the change in conductivity value being greater than the minimum threshold value. In such embodiments, the step 540 may further include providing a first notification in response to the presence of oxygen bleach being detected within the wash fluid. Additionally, or alternatively, in such embodiments, the step 540 may include adjusting the wash cycle in response to the presence of oxygen bleach being detected within the wash fluid. As described in more detail above, adjusting the wash cycle may generally include adjusting the time of the wash cycle, or may additionally include adjusting the rinse cycle.

Additionally or alternatively, in some embodiments, the step 540 may be based, at least in part, on conductivity measurements and/or turbidity measurements of the wash fluid. For instance, in some embodiments, an increase in the conductivity measurement of the wash fluid may correspond to an increase in the turbidity measurement of the wash fluid. This increase in the conductivity measurement and the turbidity measurement may be utilized to further determine that oxygen bleach is present within the wash fluid.

Alternatively, in some embodiments, at step 540 the presence of oxygen bleach may not be detected within the wash fluid in response to the conductivity value being less than or equal to the minimum threshold value. In such embodiments, the step 540 may further include providing a second notification in response to the presence of oxygen bleach not being detected within the wash fluid.

Embodiments of the present subject matter advantageously utilize a method of operating a washing machine appliance wherein oxygen bleach that has been added to the tub of the washing machine appliance may be sensed during the wash cycle. A conductivity sensor disposed at the tub of the washing machine appliance may advantageously detect the conductivity of a wash fluid within the tub and compare it to the conductivity of liquid water, for example, a baseline conductivity measurement. Based on the change in conductivity value, for example, the difference in conductivity between the conductivity of the wash fluid and the conductivity of liquid water, oxygen bleach may, or may not be, advantageously detected within the wash fluid.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the method comprising:

initiating a wash cycle of a washing machine appliance, wherein the wash cycle is the primary cycle for washing articles held within a basket of the washing machine appliance;

sensing, with a conductivity sensor, a conductivity measurement of a wash fluid within a tub of the washing machine appliance during the wash cycle;

determining, based on the sensed conductivity measurement and a baseline conductivity measurement, a change in conductivity value, the baseline conductivity measurement being indicative of liquid water flowed into the tub during a previous rinse cycle executed prior to the initiation of the wash cycle; and detecting, based on the change in conductivity value, a presence of oxygen bleach within the wash fluid.

2. The method of claim 1, wherein initiating a wash cycle comprises flowing a fill of liquid water into the tub.

3. The method of claim 1, wherein detecting the presence of oxygen bleach is further based on a minimum threshold value.

4. The method of claim 3, wherein the minimum threshold value is approximately seven hundred micro-Siemens per centimeter.

5. The method of claim 3, wherein detecting the presence of oxygen bleach comprises detecting the change in conductivity value as greater than the minimum threshold value.

6. The method of claim 5, further comprising providing a first notification in response to the presence of oxygen bleach being detected within the wash fluid.

7. The method of claim 5, further comprising adjusting the wash cycle in response to the presence of oxygen bleach being detected within the wash fluid, wherein adjusting the wash cycle comprises adding extra time to the wash cycle.

8. The method of claim 5, further comprising adjusting a rinse cycle in response to the presence of oxygen bleach being detected within the wash fluid, wherein adjusting the rinse cycle comprises providing a water volume adjustment, providing an additional rinse cycle, or a combination thereof.

9. The method of claim 3, wherein the presence of oxygen bleach is not detected within the wash fluid in response to the conductivity value being less than or equal to the minimum threshold value, further comprising continuing the wash cycle.

10. The method of claim 9, further comprising providing a second notification in response to the presence of oxygen bleach not being detected within the wash fluid.

11. A washing machine appliance comprising;

a tub;

a basket rotatably mounted within the tub;

a conductivity sensor disposed at the tub; and a controller operable for:

initiating a wash cycle of the washing machine appliance, the wash cycle being the primary cycle for washing articles held within the basket;

sensing, with the conductivity sensor, a conductivity measurement of a wash fluid within the tub during the wash cycle;

determining, based on the sensed conductivity measurement and a baseline conductivity measurement, a change in conductivity value, the baseline conductivity measurement being indicative of liquid water flowed into the tub during a previous rinse cycle executed prior to the initiation of the wash cycle; and detecting, based on the change in conductivity value, a presence of oxygen bleach within the wash fluid.

12. The washing machine appliance of claim 11, wherein initiating a wash cycle comprises flowing a fill of liquid water into the tub.

13. The washing machine appliance of claim 11, wherein detecting the presence of oxygen bleach is further based on a minimum threshold value.

14. The washing machine appliance of claim 13, wherein the minimum threshold value is approximately seven hundred micro-Siemens per centimeter.

15. The washing machine appliance of claim 13, wherein detecting the presence of oxygen bleach comprises detecting the change in conductivity value as greater than the minimum threshold value.

16. The washing machine appliance of claim 15, wherein the controller is further operable for providing a first notification in response to the presence of oxygen bleach being detected within the wash fluid.

17. The washing machine appliance of claim 15, wherein the controller is further operable for adjusting the wash cycle in response to the presence of oxygen bleach being detected within the wash fluid, wherein adjusting the wash cycle comprises adding extra time to the wash cycle.

18. The washing machine appliance of claim 15, wherein the controller is further operable for adjusting a rinse cycle in response to the presence of oxygen bleach being detected within the wash fluid, wherein adjusting the rinse cycle comprises providing a water volume adjustment, providing an additional rinse cycle, or a combination thereof.

19. The washing machine appliance of claim 13, wherein the presence of oxygen bleach is not detected within the wash fluid in response to the conductivity value being less than or equal to the minimum threshold value, further comprising continuing the wash cycle.

20. The washing machine appliance of claim 19, wherein the controller is further operable for providing a second notification in response to the presence of oxygen bleach not being detected within the wash fluid.

* * * * *